US006732511B2

(12) United States Patent
Unbehaun et al.

(10) Patent No.: US 6,732,511 B2
(45) Date of Patent: May 11, 2004

(54) EXHAUST FLAP

(75) Inventors: Martin Unbehaun, Nürnberg (DE); Frank Jürgen Lehringer, Wernsdorf (DE); Gerhard Zintel, Nürnberg (DE); Gerhard Olejniczak, Schwarzenbruck (DE)

(73) Assignee: Faurecia Abgastechnik GmbH, Fuerth (DE)

( * ) Notice: Subject to any disclaimer, the term of this patent is extended or adjusted under 35 U.S.C. 154(b) by 0 days.

(21) Appl. No.: 10/046,324

(22) Filed: Oct. 19, 2001

(65) Prior Publication Data

US 2002/0189248 A1 Dec. 19, 2002

(30) Foreign Application Priority Data

Jun. 19, 2001 (DE) ..... 101 28 949

(51) Int. Cl.[7] ..... F01N 7/00
(52) U.S. Cl. ..... 60/324
(58) Field of Search ..... 60/324, 317

(56) References Cited

U.S. PATENT DOCUMENTS

| | | | | | |
|---|---|---|---|---|---|
| 1,720,789 | A | * | 7/1929 | Heusser | 220/830 |
| 2,494,016 | A | * | 1/1950 | Taylor | 454/5 |
| 2,508,615 | A | * | 5/1950 | Lukes | 454/6 |
| 2,983,216 | A | * | 5/1961 | Stade et al. | 454/5 |
| 3,274,917 | A | * | 9/1966 | Tolbert, Sr. | 454/5 |
| 3,363,537 | A | * | 1/1968 | Penning | |
| 3,407,720 | A | * | 10/1968 | Westerman | 454/5 |
| 3,523,499 | A | * | 8/1970 | Bauerschmidt | 220/32 |
| 3,788,072 | A | * | 1/1974 | Burger | 454/2 |
| 3,791,282 | A | | 2/1974 | McElhose et al. | |
| 3,847,297 | A | * | 11/1974 | Baader et al. | 137/382 |
| 3,964,376 | A | * | 6/1976 | Janke | 454/5 |
| 4,143,731 | A | * | 3/1979 | Haustein | 180/89.2 |
| 4,162,740 | A | | 7/1979 | Jones | 220/18 |
| 4,205,706 | A | * | 6/1980 | Jasensky | 137/468 |
| 4,226,173 | A | * | 10/1980 | Khosropour | 137/382 |
| 4,255,928 | A | * | 3/1981 | Jones et al. | 454/2 |
| 4,667,582 | A | * | 5/1987 | Davison et al. | 454/360 |
| 4,719,752 | A | * | 1/1988 | Hall | 180/309 |
| 4,727,796 | A | * | 3/1988 | Derkach | 248/230.7 |
| 4,742,766 | A | * | 5/1988 | Davison et al. | 454/2 |
| 5,267,894 | A | * | 12/1993 | Schuck | 454/5 |
| 5,327,933 | A | | 7/1994 | Ishikawa et al. | 137/527.6 |
| 5,801,343 | A | | 9/1998 | Suzuki et al. | 181/254 |

FOREIGN PATENT DOCUMENTS

| | | |
|---|---|---|
| DE | 43 02 519 A1 | 8/1994 |
| DE | 199 35 711 C 1 | 12/2000 |
| GB | 2 274 681 A | 8/1994 |
| JP | 57 135 217 A | 8/1982 |
| JP | 11 193 710 A | 7/1999 |

* cited by examiner

*Primary Examiner*—Thomas Denion
*Assistant Examiner*—Diem Tran
(74) *Attorney, Agent, or Firm*—Laurence A. Greenberg; Werner H. Stemer; Ralph E. Locher

(57) ABSTRACT

The exhaust flap closes an exhaust duct. An exhaust-gas stream flows directly onto a closure plate which closes the cross section of the exhaust duct at least partially. A flow body is disposed next to the closure plate, onto which the exhaust-gas stream can flow and which takes effect as an actuator for the exhaust flap.

12 Claims, 7 Drawing Sheets

EXHAUST FLAP

BACKGROUND OF THE INVENTION

Field of the Invention

The present invention relates to an exhaust flap for an exhaust system of an internal combustion engine. Exhaust flaps of this type serve for closing the exhaust duct of an exhaust system. It may be desirable, in this context, to close the entire cross section of the exhaust duct by means of the exhaust flap. It is just as possible, however, to close only a partial region of the cross section of the exhaust duct by means of the exhaust flap. It is also possible, furthermore, to subdivide the exhaust duct into a plurality of partial ducts and also connect these partial ducts in parallel. The exhaust flap according to the invention is then also suitable for closing such a partial duct completely or partially, while the parallel partial duct can operate without an exhaust flap. The exhaust flaps are conventionally designed in such a way that they can be tilted either in various steps or continuously, in such a way that the initially closed cross section of the exhaust duct can be opened. In particular, it is possible for the exhaust flap to be tilted back and forth between a closing position, wherein the exhaust duct is completely closed, and an opening position, wherein the exhaust duct is completely open.

The exhaust flaps according to the invention can be used both in the hot and in the cold region of the exhaust system. A typical field of use is the function as a valve, for example for controlling a bypass in order to bypass a heat exchanger or catalyst. Another typical field of use is the closing of an end pipe. Finally, it is also customary, in the area of sound damping, to open and close various flow paths within the silencer with the aid of exhaust flaps.

In this context, German patent DE 199 35 711 C discloses a silencer with an exhaust flap, wherein an actuating element is acted upon directly by the exhaust-gas stream in order to actuate a closing element forming the actual exhaust flap. One disadvantage of that configuration is the need to have to provide both an actuating element and a closing element. To be precise, these parts are very costly, because, on account of the leak tightness and corrosion and heat resistance required here, the mounting of parts moveable in this way is highly complicated and therefore very costly. The above-mentioned publication also mentions directly controlling flap systems, wherein the exhaust-gas stream acts directly upon the exhaust flap. However, it is disadvantageous with the configurations mentioned there that they do not allow a stable operating behavior or increase the exhaust-gas back-pressure too sharply when there is a high gas throughput.

SUMMARY OF THE INVENTION

It is accordingly an object of the invention to provide an exhaust flap for closing an exhaust duct, which overcomes the above-mentioned disadvantages of the heretofore-known devices and methods of this general type and which has a further simplified configuration, and at the same time ensures stable operating behavior.

With the foregoing and other objects in view there is provided, in accordance with the invention, an exhaust flap for closing an exhaust duct conducting an exhaust-gas stream, the exhaust flap comprising:

a closure plate directly impinged by the exhaust-gas stream and disposed to at least partially close a cross section of the exhaust duct; and a flow body disposed adjacent the closure plate and to be impinged by the exhaust-gas stream, the flow body forming an actuator for the exhaust flap.

The basic idea of the invention is to provide on the exhaust flap a closure plate performing the closing function and also to arrange a flow body additionally next to the closure plate. The closure plate and the flow body are consequently connected to one another and also pivot synchronously with one another as parts of the exhaust flap. In this case, as regards a rectangular closure plate, the flow body may be arranged next to each of the four sides of this rectangle. The closure plate may in this case be configured in such a way that, in the closing position, it closes the exhaust duct completely. It is just as possible by means of the invention to close only a part region of the cross section of the exhaust duct. Since the closure plate is arranged directly in the exhaust duct, the exhaust-gas stream also impinges directly onto the closure plate inner face confronting it. The exhaust-gas stream consequently exerts a dynamic pressure on the inner face of the closure plate. This dynamic pressure is utilized as the opening force for the closure plate and consequently for the exhaust flap. As a result of the dynamic pressure exerted on the closure plate, the exhaust flap can open up to a particular opening angle. Practical tests have yielded the result that, for example on acoustically active exhaust flaps, an opening angle of about 30° can be achieved with the aid of the dynamic pressure. The dynamic pressure exerted on the inside of the closure plate is not sufficient, however, for opening the exhaust flap completely, particularly because the opening movement of the exhaust flap is additionally impeded by the force of a return element usually designed as a return spring.

As soon as the exhaust flap opens and the flow body is no longer concealed, the exhaust-gas stream begins to flow onto the flow body arranged next to the closure plate. As a result of this flow onto the flow body, the exhaust flap is opened further, so that the flow body takes effect as an actuator for the exhaust flap. Stable operating behavior of the exhaust flap is ensured in this way. Another advantage of the invention is that no further moveable parts which have to be mounted in a complicated way are present in addition to the exhaust flap. Instead, the exhaust flap is designed as an integral structural part which fulfils at the same time both the actuating function and the closing function of an exhaust flap.

In accordance with an added feature of the invention, the exhaust flap is arranged at an end of a duct portion of the exhaust duct and pivotally mounted counter to a biasing force which may be provided by a return element, such as a return spring disposed to force the exhaust flap to close off the exhaust duct. The fact that the exhaust flap is arranged in the exhaust duct at the end of a duct portion renders it possible, for example, to connect a plurality of parallel exhaust duct portions in series in the manner of a register. The arrangement in the region of the end of a duct portion has the advantage that the mounting for the exhaust flap can be arranged outside the exhaust duct and therefore outside the exhaust-gas stream. The flow of the exhaust-gas stream in the exhaust duct is thereby not impeded by the mounting. It is also thus possible to adapt the size of the exhaust duct to the exhaust-gas stream and so optimize the flow behavior in the exhaust duct. Finally, it is advantageous to provide the exhaust flap with a return spring, in order to prevent an undesirable generation of noise, for example rattling during the closing of the flap or when the dynamic pressure exerted on the exhaust flap is relatively slight.

In accordance with an additional feature of the invention, the exhaust flap has a U-shaped cross section with U-legs each forming a flap side wall and the closure plate forming a U-crosspiece connecting the U-legs. This exhaust flap construction has a simple design and at the same time is highly effective. By virtue of its U-shaped cross section, the exhaust flap closes the exhaust duct highly effectively. This construction is further developed where the flap side walls extend in a fork-like manner for additionally holding the flow body therebetween. The walls thus form a fork-like receptacle of the flow body between the flap side walls. The inner faces of the flap side walls and the inner face of the closure plate act in the same way as a guide blade of a turbine in this design and thus assist the subsequent flow onto the flow body in a particularly advantageous way.

In accordance with another feature of the invention, the flow body is a planar plate enclosing an obtuse angle with a plane defined by the closure plate. Alternatively, the flow body is a curved plate disposed to form an angle of incidence with a plane of the closure plate. In a specifically preferred embodiment of the invention, the flow body is configured as an airfoil.

In other words, it is possible for the flow body to be designed likewise as a plane plate in a similar way to the closure plate. This is very simple in design terms. Alternatively to this, in order to improve the flow behavior, a curved shape of the flow body may also be considered. The airfoil embodiment is considered particularly expedient. In this case, in a similar way to the wing of an aircraft, there is first a flow onto the end face of the wing and the exhaust-gas stream is as it were divided into two. Since the exhaust-gas stream builds up a higher velocity on the topside of the wing than on the underside of the wing, the static pressure above the wing is lower than on the underside of the wing, thus having the effect of an additional lift of the wing and therefore of the exhaust flap, with the result that the exhaust flap is opened further. A complete opening of the exhaust flap can be achieved, in particular, in combination with the design of the flap side walls and of the closure plate in the manner of a turbine guide blade.

In accordance with a further feature of the invention, it is also possible to arrange a plurality of flow bodies next to one another. In this case, for reasons of space, it may be expedient to arrange the flow bodies in such a way that they operate simultaneously, that is to say are connected in parallel. It is just as possible, however, for the flow bodies to be arranged so as to be coordinated with one another in such a way that they take effect only in succession in the manner of a register connection. Finally, it is also possible to connect a plurality of flow bodies in series.

In accordance with a concomitant feature of the invention, the closure plate has a fixed end articulated to the exhaust duct and a free end opposite the fixed end, and the flow body or flow bodies is/are arranged at the free end, and a hinge joint and a return spring are arranged at the fixed end.

In other words, it is expedient to provide the pivot bearing for the exhaust flap at one end, the fixed end, and to arrange the flow body at the other end of the exhaust flap, to be precise at the free end facing away from the fixed end. In this way, the pivot bearing and the flow body are arranged far away from one another, so that the effective lever arm and therefore the torque acting on the exhaust flap during a flow onto the flow body are very high, thus ensuring a rapid and reliable opening of the exhaust flap.

Other features which are considered as characteristic for the invention are set forth in the appended claims.

Although the invention is illustrated and described herein as embodied in Exhaust Flap, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
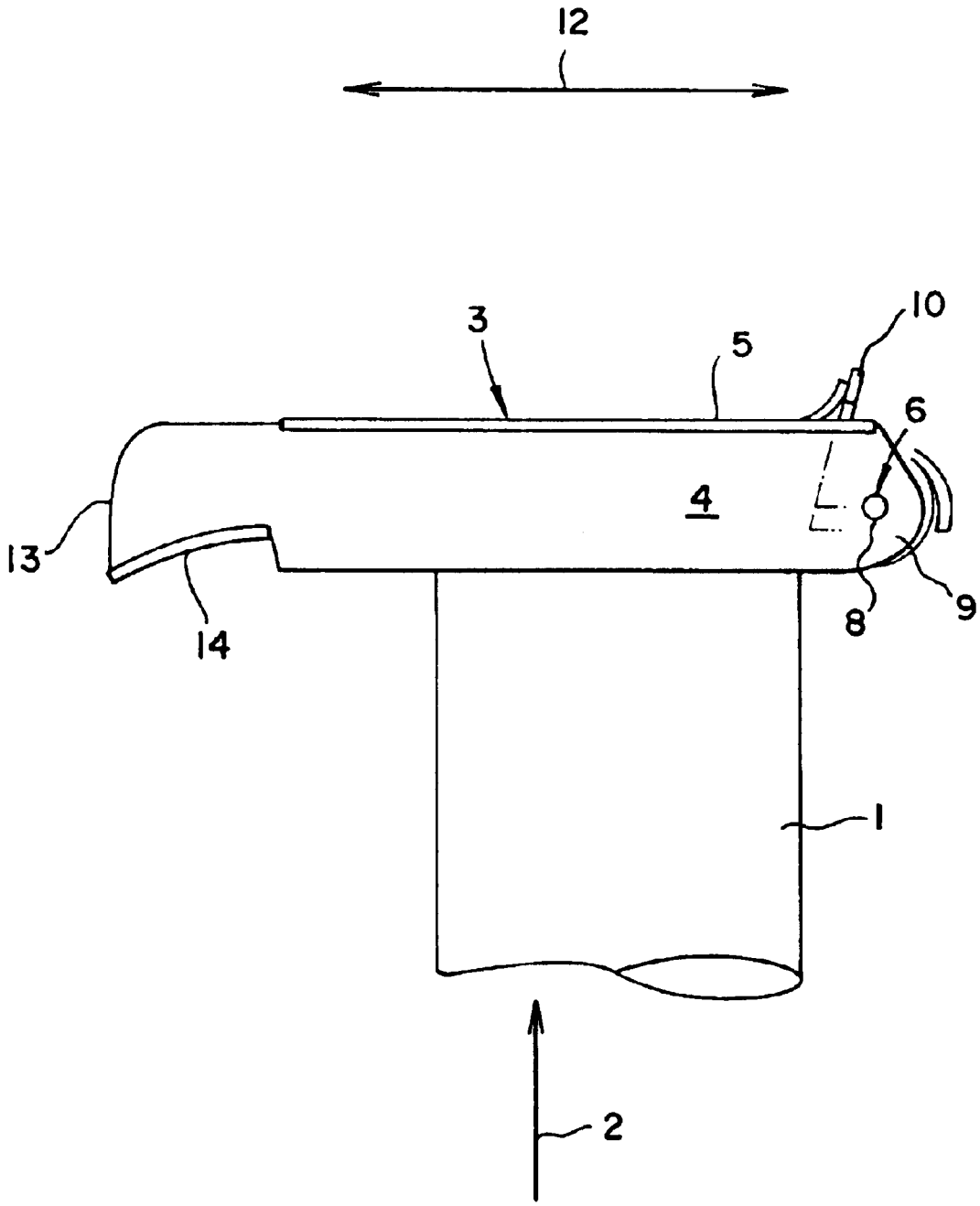
FIG. 1 is a side elevational view of an exhaust duct end with the exhaust flap completely closed.
Figure 6:
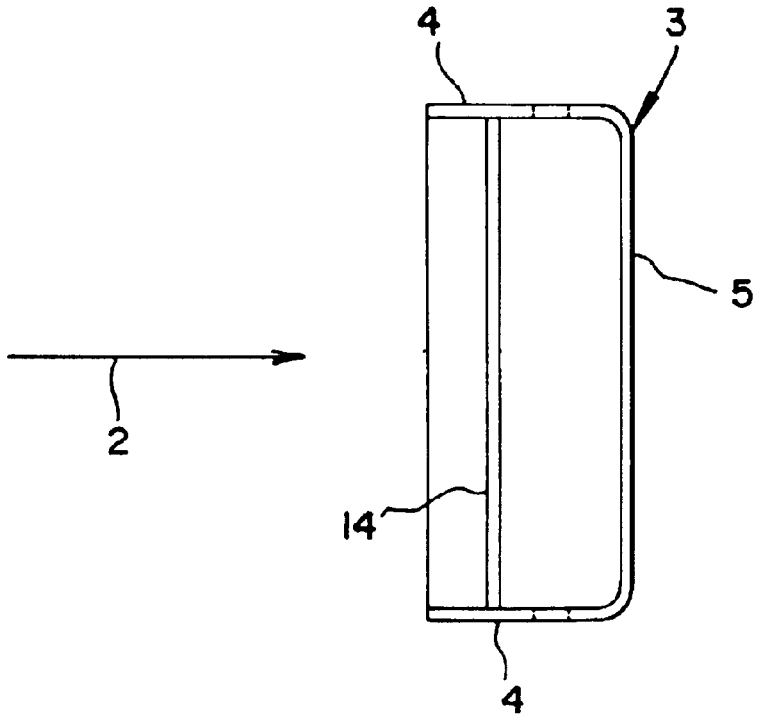
FIG. 6 is a front view of the exhaust flap viewed in the direction of the arrow VI in FIG. 5.
Figure 7:
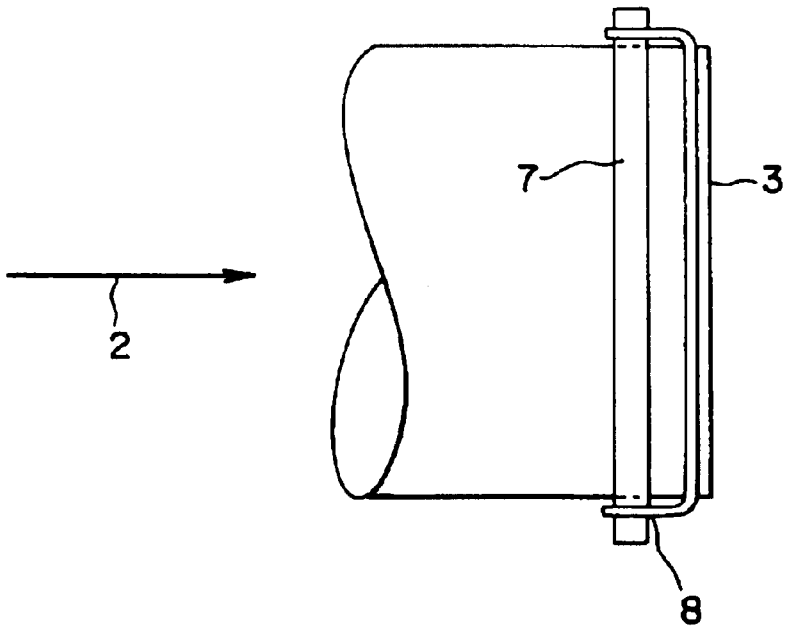
FIG. 7 is a diagrammatic side view of the rotary mounting of the exhaust flap on the exhaust duct viewed in the direction of the arrow VII in FIG. 4.

Referring now to the figures of the drawing in detail and first, particularly, to FIG. 1 thereof, there is shown a duct 1 which has an exhaust-gas stream flowing through it in the direction of flow 2. An end face of the duct 1 is closed off by an exhaust flap 3. FIG. 1 consequently shows the exhaust flap 3 in its closing position. The exhaust flap 3 has a U-shaped cross section (FIG. 6), the flap side walls 4 forming the U-legs which are connected to one another by means of the U-crosspiece formed by the closure plate 5. The closure plate 5 and the flap side wall 4 that face the viewer can be seen in FIG. 1. The exhaust flap 3 is pivotally mounted about a hinge joint 6. The hinge joint 6 is formed by a hinge pin 7 which passes in each case through a bearing plug 8 in the region of the fixed end 9 in each flap side wall 4.

One leg of a return spring 10, constructed as a leg spring, can also be seen in FIG. 1. The leg of the return spring 10 engages in a recess 11 integrally formed in the exhaust flap 3 in the region of the closure plate 5.

The flow body 14, configured as an airfoil, is mounted in the region of the free end 13 facing away from the fixed end 9 (i.e., the pivot end) in the transverse direction 12 running at right angles to the direction of flow 2. The flow body 14 is arranged next to the closure plate 5 in the transverse direction 12. In the exemplary embodiment, the closure plate 5 and the flow body 14 do not overlap one another in the transverse direction 12. Moreover, the flow body 14 is arranged in the region of the lower edge of the flap side walls 4, that is, in a different plane from the closure plate 5 in the direction of flow 2. The flow body 14 is mounted between the flap side walls 4 which, for this purpose, are extended in a fork-like manner beyond the closure plate 5 in the transverse direction 12.

Figure 2:
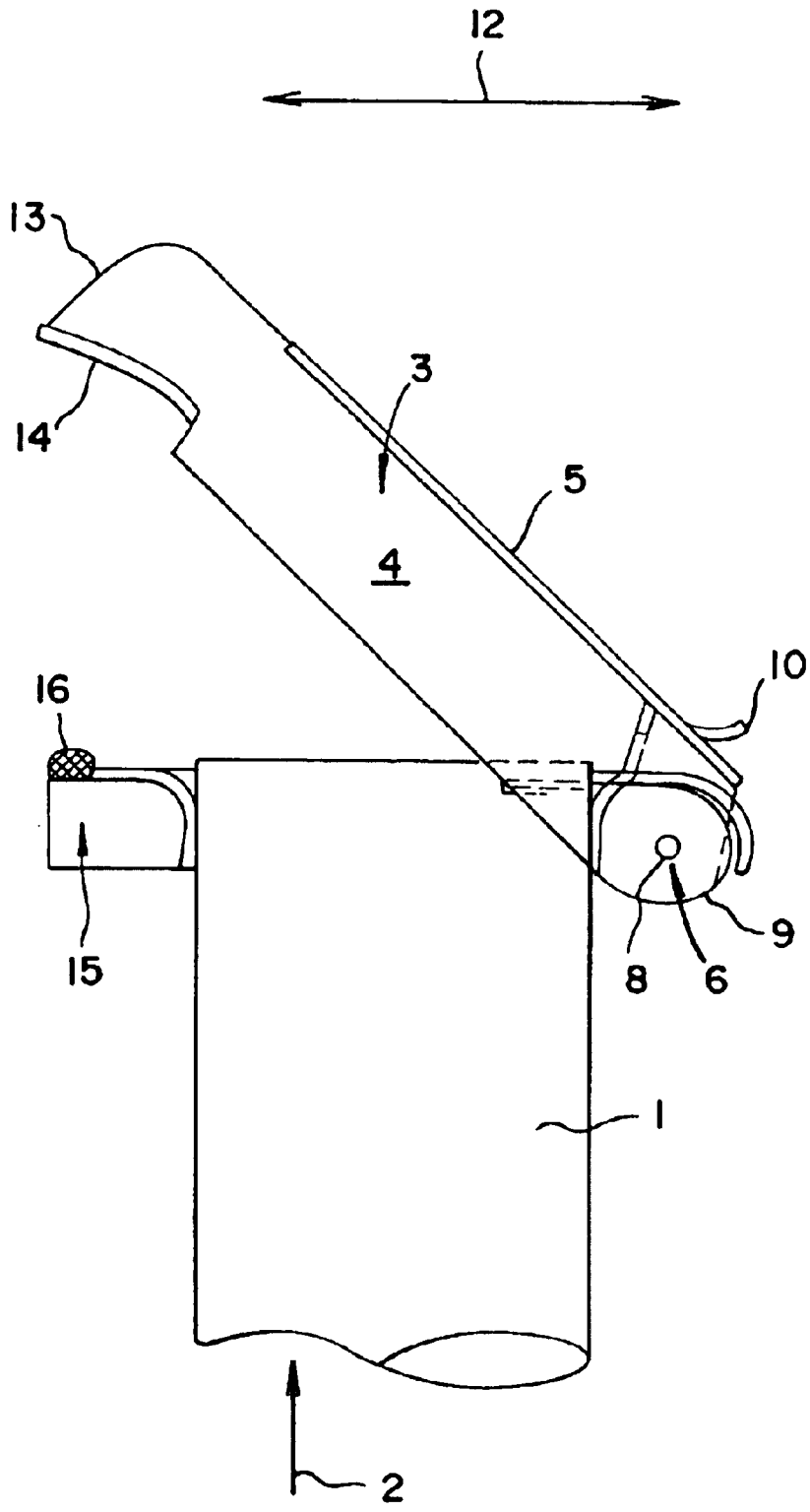
FIG. 2 is a similar view with the exhaust flap partially open.
Figure 3:
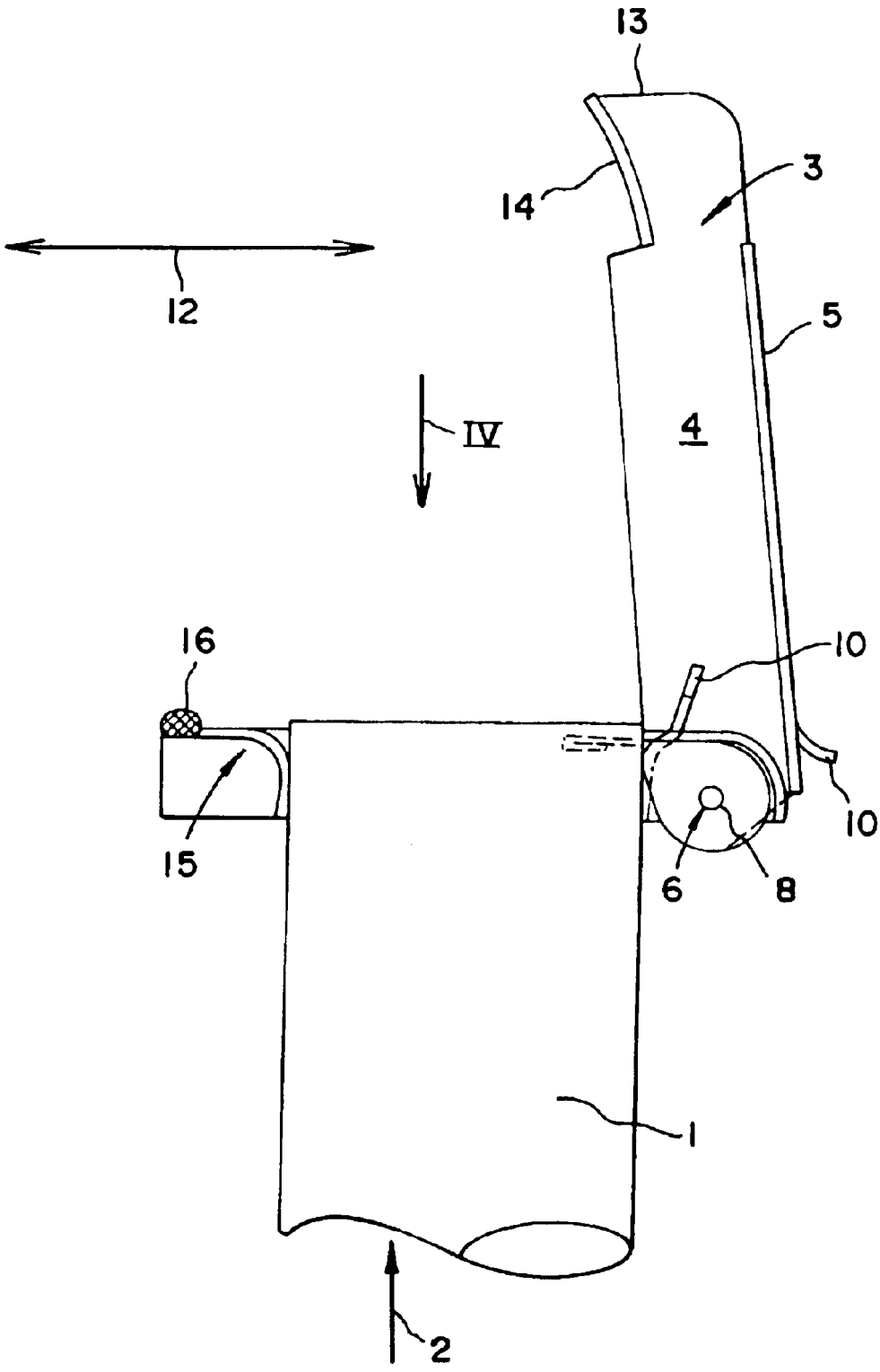
FIG. 3 is a similar view with the exhaust flap completely open.
Figure 4:
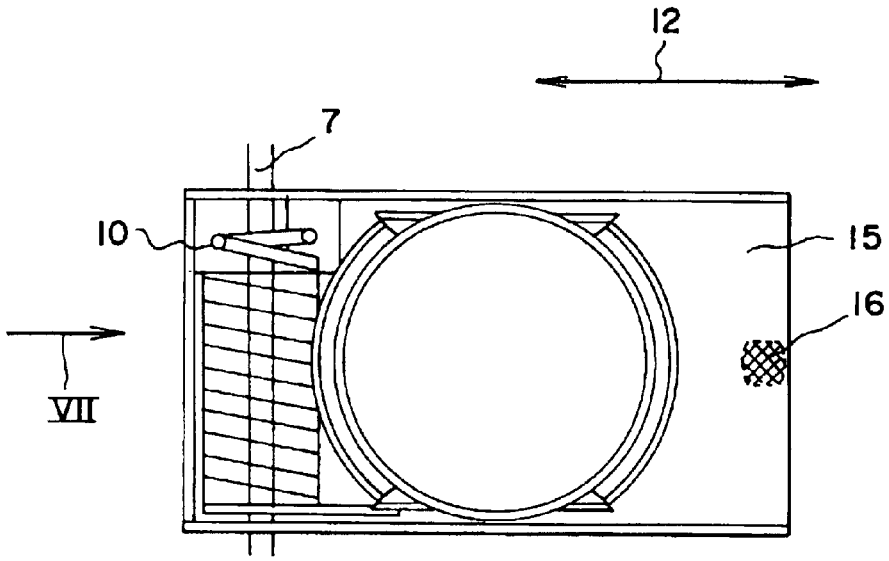
FIG. 4 is a plan view into the exhaust duct viewed in the direction of the arrow IV in FIG. 3.
Figure 5:
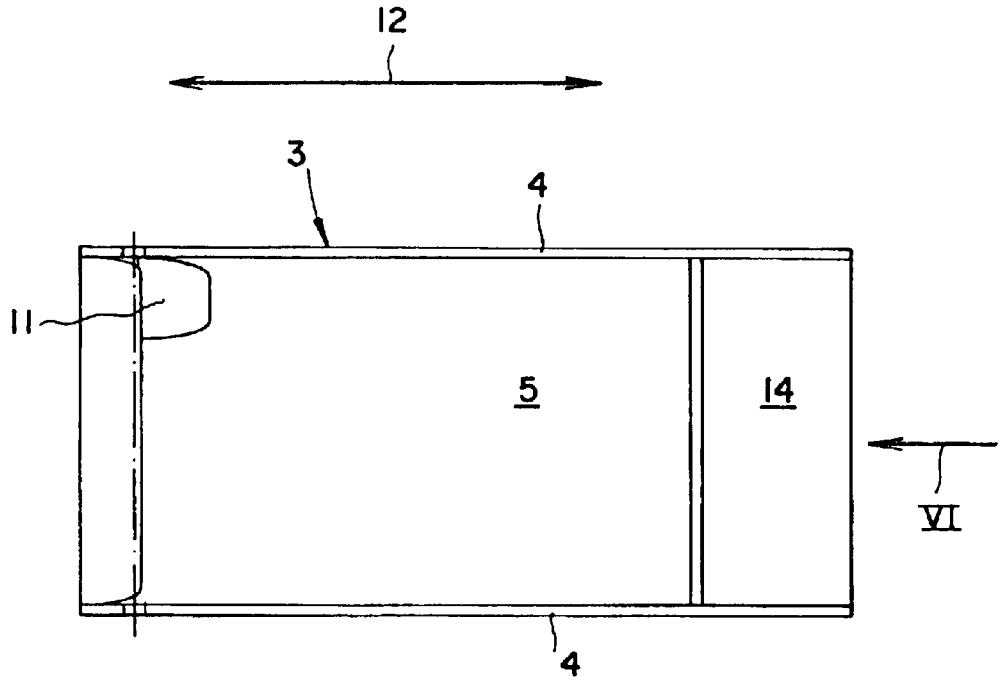
FIG. 5 is a bottom view of the exhaust flap.
Figure 8:
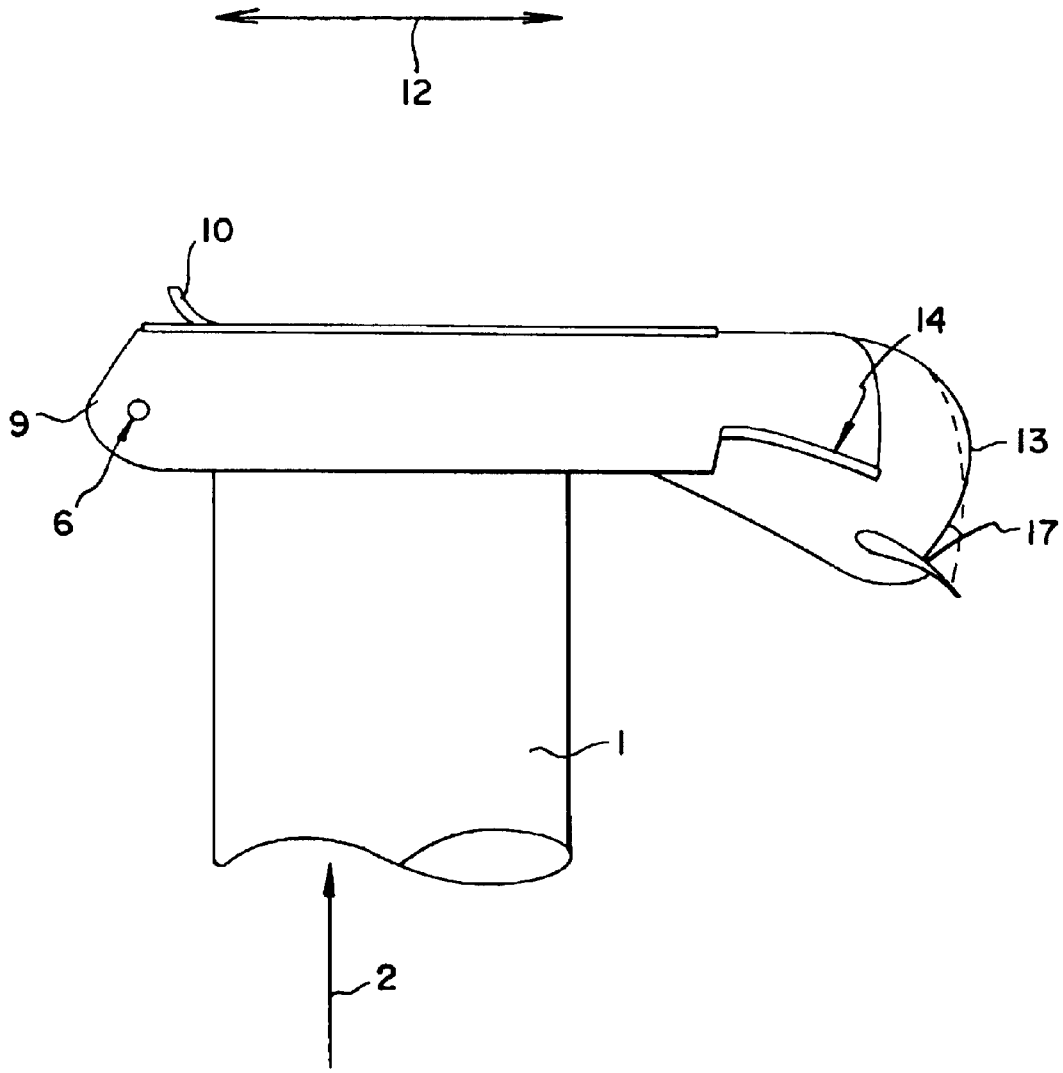
FIG. 8 is a further side view of an exhaust duct end with an embodiment of an exhaust flap having a plurality of flow bodies, in the closed position.

Referring now to FIGS. 2 and 3, a stop 15 for the exhaust flap 3 faces away from the hinge joint 6 in the transverse direction 12 in the region of the orifice of the exhaust duct 1. The stop 15 is configured as a sheet-metal flange and carries a soft knitted wire fabric 16 which functions as a stop cushion. The knitted wire fabric 16 prevents rattling noises from the exhaust flap 3 when the latter rests in the closed state on the stop 15. It can be seen in the illustration of FIG. 4 that the stop 15 is designed as a substantially rectangular flange, in adaptation to the shape, which can be seen in FIG. 5, of the likewise rectangular closure plate 5 of the exhaust flap 3. Finally, FIG. 8 illustrates a further embodiment of the exhaust flap 3. In the region of the free end 13, an additional flow body 17 is provided next to the flow body 14. In the exemplary embodiment, the additional flow body 17 is also designed, like the flow body 14, as an airfoil. The airfoils forming the flow body 14 and the additional flow body 17 can normally be produced cost-effectively as bent sheet-metal parts.

The operation of the exhaust flap 3 according to the invention will be explained with reference to FIGS. 1–3.

FIG. 1 illustrates the closing position of the exhaust flap 3. In this case, the closure plate 5 rests on the flange-like stop 15 at the end of the exhaust duct 1. No exhaust-gas stream flows through the exhaust duct 1 in FIG. 1.

As soon as an exhaust-gas stream flows through the exhaust duct 1 in the direction of flow 2, the inside of the closure plate 5, said inside confronting the exhaust duct 1, is acted upon by the exhaust-gas stream, so that a dynamic pressure builds up on the inside of the closure plate 5. This dynamic pressure exerts on the closure plate 5, and therefore also on the entire exhaust flap 3, a force which is active in the direction of flow 2, so that the exhaust flap 3 is partially opened counter to the spring pressure of the return spring 10, as illustrated in FIG. 2. The exhaust flap 3, as it were driven by the dynamic pressure, lifts off from the knitted wire fabric 16 on the stop 15 and is pivoted open around the hinge joint 6.

This opening position produced by the dynamic pressure is shown in FIG. 2. In the open state, the exhaust-gas stream is conducted on the insides both of the closure plate 5 and of the flap side walls 4 in the direction of the free end 13. In this case, the insides of the closure plate 5 and of the flap side walls 4 have the effect of a guide blade of a turbine and bring about a specifically directed flow onto the flow body 14. As a result of this conducted flow, the exhaust-gas stream impinges onto the end face of the flow body 14 and flows both along the underside, confronting the exhaust duct 1, of the flow body 14 and along the topside, confronting the closure plate 5, of the flow body. Since the velocity of the air stream is higher on the topside of the flow body 14 confronting the closure plate 5 than on the underside, the flow body 14 acts in the manner of an aircraft wing, so that the flow generates a lift.

As a result of the lift, the exhaust flap 3 is opened completely out of its approximately half-open position shown in FIG. 2, as illustrated in FIG. 3. The exhaust-gas stream can flow, completely unimpeded, through the exhaust duct 1.

The dynamic pressure of the flow which impinges onto the underside of the closure plate can generate only a force such that the exhaust flap 3 can move into a half-open position according to FIG. 2 counter to the spring force of the return spring 10. By contrast, a complete opening of the exhaust flap 3 can be achieved with the aid of the additional flow body 14 according to the invention which is mounted on the exhaust flap 3. This is desirable, above all, in the full-load power output mode, because, here, an exhaust flap 3 projecting into the cross section of the exhaust duct 1 would be a flow obstacle and would have a power-limiting effect. It is important, in this respect, that any desired flap opening position can be implemented with the aid of the exhaust-gas stream, because it may even be perfectly desirable, in various applications, not to have the exhaust flap 3 completely open. With the aid of the invention, therefore, it is possible to set the exhaust flap 3 or regulate the opening angle of the exhaust flap 3 continuously between its closing position and its complete opening position solely via the exhaust-gas stream.

Figure 9:
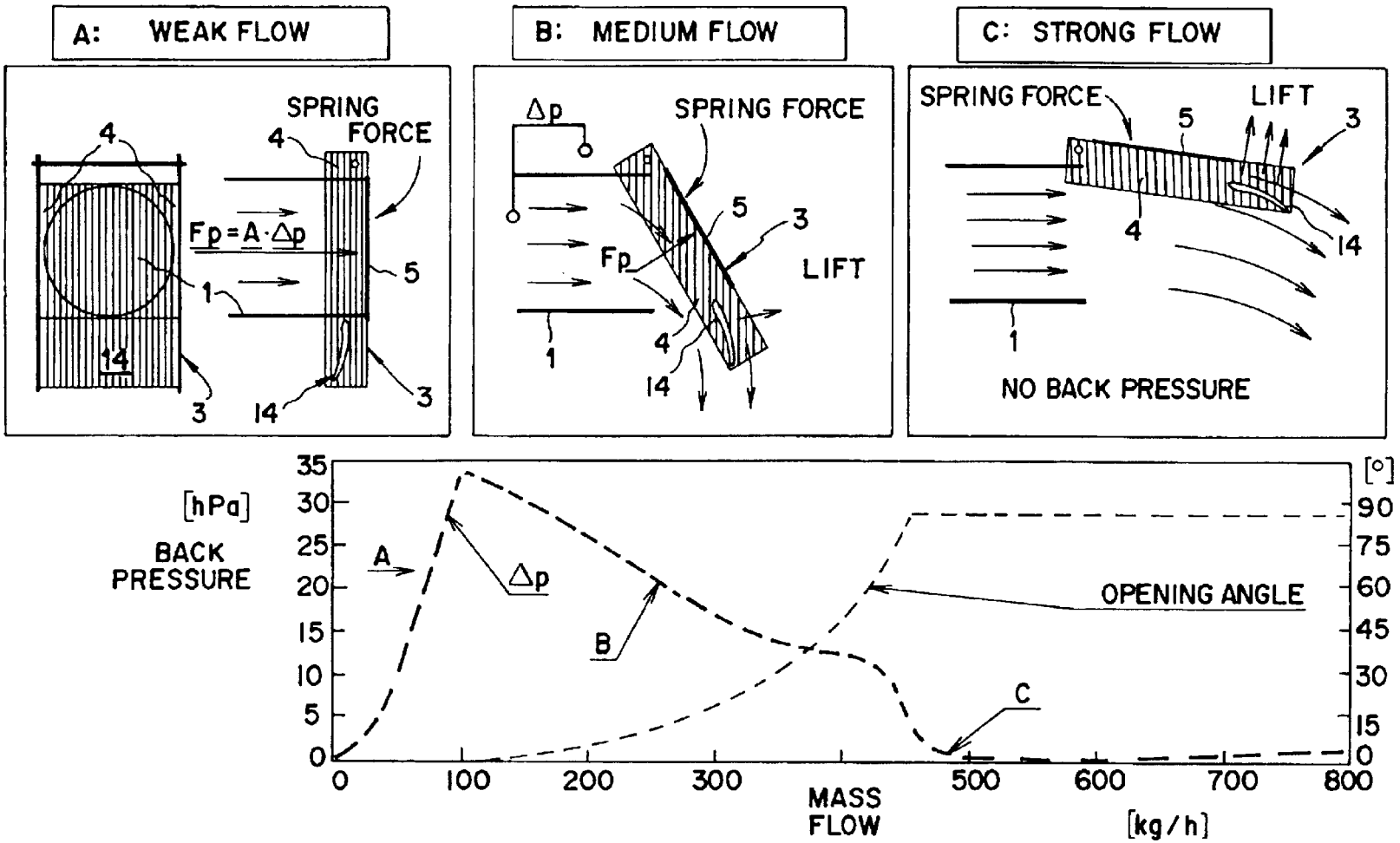
FIG. 9 shows basic illustrations of three functional positions of the exhaust flap and also the curve of the backpressure profile and the curve of the opening angle, plotted against the mass flow.

The above-explained operation of the exhaust flap 3 according to the invention can also be seen from FIG. 9. In the top half of FIG. 9, the positions of the exhaust flap 3 which are shown in FIG. 1, FIG. 2 and FIG. 3 are reproduced diagrammatically once again with some explanations. The reproduction at the top left shows the exhaust flap 3 in the closed state (similar to FIG. 1). In the closed state, at most a slight flow flows through the exhaust duct 1. This flow is illustrated by the arrows in the exhaust duct 1.

The table in the lower part of FIG. 9 shows the mass flow, measured in kg/h, on the abscissa. The backpressure acting on the closure plate 5 of the exhaust flap 3 is illustrated in hPa on the left ordinate. The thick broken line in the graph shows the profile of the backpressure referred to the mass flow. With the exhaust flap 3 closed, that is to say with a slight flow at the point A, the mass flow is about 80 kg/h and the backpressure is about 22 hpa. At a mass flow of 100 kg/h, the backpressure reaches a maximum at about 35 hPa, and the exhaust flap 3 is opened. When the flow increases further, that is to say the mass flow rises, the state of medium flow, illustrated in the middle illustration of the top half of FIG. 9, is reached. The flow body 14 generates a lift in this case. At a mass flow of 250 kg/h, the backpressure falls from the maximum to about 20 hPa (the point B on the thick broken line). At this mass flow, the opening angle of the exhaust flap 3 is about 15°. The opening angle is charted on the right-hand ordinate in FIG. 9. To be precise, the thin broken line in FIG. 9 shows the opening angle of the exhaust flap 3 in relation to the mass flow.

It can therefore easily be seen from the illustration of FIG. 9 that a strong flow, that is to say an increase in the mass flow, leads to the effective backpressure of the exhaust flap 3 approaching zero, while the exhaust flap opens completely to 90°. The functional positions "A: Weak Flow", "B: Medium Flow" and "C: Strong Flow" are also marked in each case by A, B and C in the table at the bottom in FIG. 9 and are indicated by arrows in the thick broken curve of the backpressure plotted against the mass flow. The opening angle of the exhaust flap 3 is illustrated in the table illustrated at the bottom in FIG. 9, in such a way that it always corresponds to the illustration in the basic illustration printed above it. In the case of the slight flow illustrated in the basic illustration A, the opening angle is 0°. The exhaust flap 3 is closed. In the case of the medium flow reproduced in the basic illustration B, the exhaust flap 3 begins to open, until, in the case of the strong flow illustrated in the basic illustration C, it reaches its extreme opening position with an opening angle of 90°. It should be noted expressly that FIG. 9 shows primarily the qualitative profile of the mass flow and the opening angle, and that the numerical values given relate only to an exemplary embodiment and other numerical values may be obtained in other embodiments.

We claim:

1. An exhaust flap for closing an exhaust duct conducting an exhaust-gas stream, the exhaust flap comprising:

a closure plate directly impinged by the exhaust-gas stream and disposed to at least partially close a cross section of the exhaust duct; and a flow body disposed adjacent said closure plate and to be impinged by the exhaust-gas stream, said flow body forming an actuator for said exhaust flap;

said closure plate and said flow body defining a flow gap therebetween.

2. The exhaust flap according to claim 1, wherein said exhaust flap is arranged at an end of a duct portion of the exhaust duct and pivotally mounted counter to a biasing force.

3. The exhaust flap according to claim 2, which comprises a return element disposed to effect the biasing force on said exhaust flap.

4. The exhaust flap according to claim 1, wherein said return element is a return spring biasing said exhaust flap to close off the exhaust duct.

5. The exhaust flap according to claim 1, wherein said exhaust flap has a U-shaped cross section with U-legs each forming a flap side wall and said closure plate forming a U-crosspiece connecting the U-legs.

6. The exhaust flap according to claim 5, wherein said flap side walls extended in a fork-like manner for additionally holding said flow body therebetween.

7. The exhaust flap according to claim 1, wherein said flow body is a planar plate enclosing an obtuse angle with a plane defined by said closure plate.

8. The exhaust flap according to claim 1, wherein said flow body is a curved plate disposed to form an angle of incidence with a plane of said closure plate.

9. The exhaust flap according to claim 8, wherein said flow body is configured as an airfoil.

10. The exhaust flap according to claim 1, wherein said flow body is one of a plurality of flow bodies disposed next to one another.

11. The exhaust flap according to claim 10, wherein said closure plate has a fixed end articulated to the exhaust duct and a free end opposite the fixed end, said flow bodies are arranged at said free end, and a hinge joint and a return spring are arranged at said fixed end.

12. The exhaust flap according to claim 1, wherein said closure plate has a fixed end articulated to the exhaust duct and a free end opposite the fixed end, said flow body is arranged at said free end, and a hinge joint and a return spring are arranged at said fixed end.

* * * * *